US008011860B2

(12) United States Patent
Stahm

(10) Patent No.: US 8,011,860 B2
(45) Date of Patent: Sep. 6, 2011

(54) GROUND ANCHOR

(75) Inventor: William G. Stahm, Brighton, CO (US)

(73) Assignee: Foresight Products, LLC, Commerce City, CA (US)

( * ) Notice: Subject to any disclaimer, the term of this patent is extended or adjusted under 35 U.S.C. 154(b) by 0 days.

(21) Appl. No.: 12/803,528

(22) Filed: Jun. 29, 2010

(65) Prior Publication Data

US 2010/0269422 A1 Oct. 28, 2010

Related U.S. Application Data

(62) Division of application No. 11/891,090, filed on Aug. 10, 2007, now Pat. No. 7,789,594.

(51) Int. Cl.
*E02D 3/00* (2006.01)

(52) U.S. Cl. ..... 405/302.4; 405/302.6; 52/162; 52/163

(58) Field of Classification Search ..... 405/253, 405/258.1, 259.1, 302.4, 302.6, 302.7; 52/162, 52/163; 411/80.5
See application file for complete search history.

(56) References Cited

U.S. PATENT DOCUMENTS

| | | | |
|---|---|---|---|
| 740,399 | A | 10/1903 | Clum |
| 3,080,024 | A | 3/1963 | Clevett |
| 4,044,513 | A | 8/1977 | Deike |
| 4,096,673 | A | 6/1978 | Deike |
| 4,574,539 | A | 3/1986 | Deike |
| 4,993,870 | A | 2/1991 | Bridgewater |
| 5,775,037 | A | 7/1998 | James |
| 5,815,993 | A | 10/1998 | Castola et al. |
| 5,951,202 | A | 9/1999 | Brown |
| 6,237,289 | B1 | 5/2001 | Jewett et al. |

FOREIGN PATENT DOCUMENTS

| | | |
|---|---|---|
| AU | 305214 | 2/2006 |
| AU | 305215 | 2/2006 |
| AU | 305216 | 2/2006 |
| AU | 305217 | 2/2006 |
| AU | 305218 | 2/2006 |
| EP | 0 313 936 | 5/1989 |
| EP | 0 863 261 | 9/1998 |
| GB | 2 283 510 | 5/1995 |
| GB | 2 283 511 | 5/1995 |
| GB | 2 343 473 | 5/2000 |
| GB | 2 398 808 | 9/2004 |
| WO | WO95/12771 | 5/1995 |

OTHER PUBLICATIONS

Engineer's drawing sheet 9006-0030 dated Jun. 4, 2004 of Tighter Engineering believed to be a drawing of a unit found in AU305,216, also enclosed herewith.
Photograph from website showing Fast Plant product from Italy.
Pinrtout of website showing applicant's Manta Ray Earth Anchor system.
Printout of website showing applicant's Duckbill Anchors.
Printout of website showing Platipus Earth Anchors.

*Primary Examiner* — David Bagnell
*Assistant Examiner* — Benjamin Fiorello
(74) *Attorney, Agent, or Firm* — Dennis A. Gross; The Hill Firm

(57) ABSTRACT

An earth anchor of the pivoting type having an essentially cylindrical body, a blind bore extending thereinto from a trailing axial end of the cylindrical body and a leading edge projecting from a leading end of the body, the leading edge being formed as a rounded surface adapted for penetration through reinforcement paths while minimizing severing of the strands of the mat.

11 Claims, 2 Drawing Sheets

GROUND ANCHOR

This application is a division of application Ser. No. 11/891,090 filed Aug. 10, 2007 entitled "Improved Earth Anchor," now U.S. Pat. No. 7,789,594.

BACKGROUND OF THE INVENTION

1. Field of the Invention

This invention relates to ground anchors, and more specifically to driven pivoting ground anchors.

2. General Background

Ground anchors, or earth anchors, of the driven and pivoting or tilting type are well known and generally include a main body portion having a leading edge adapted to be driven into the ground, a trailing edge including an outturned lip and a cable or rod or guide wire attachment point intermediate the leading and trailing edges generally positioned from about the midpoint of the overall length of the anchor or towards the trailing edge so that upon exertion of the force on the cable or attached rod or guide wire, after insertion of the anchor into the ground, the trailing edge's outturned lip will bite into the earth, causing the anchor to rotate or pivot to a locked position generally at a right angle to the withdrawal force.

Widely currently used driven pivoting anchors of the type described are available from the assignee of this application under its Duckbill trademark and generally employ a somewhat cylindrical main body portion having an attachment point intermediate its ends and having at its forward end a plurality of forwardly extending guiding plane surfaces which terminate in chiseled edges. The cylindrical body shaped member, at its trailing end, has a bore extending into the body of the cylindrical member for receipt of a drive rod for driving the anchor into the earth and is provided with an outturned lip on a side of the cylindrical body portion opposite the side having the cable or guide wire attachment point.

Such anchors are shown, for example, in U.S. Pat. Nos. 4,044,513 and 4,096,673, both of which are assigned to the assignee of this application. Improvements of such anchors are well Such anchors are shown, for example, in U.S. Pat. Nos. 4,044,513 and 4,096,673, both of which are assigned to the assignee of this application. Improvements of such anchors are well known and include, for example, applicant's pending Design application Ser. No. 29/270,187 and U.S. Utility application Ser. No. 11/803,138 filed May 14, 2007.

Other variants of such anchors are sold, for example, by Foresight Products, LLC under trademarks Manta Ray and Stingray and employ extensive side projecting wings that extend backwardly and outwardly from the leading edges to a greater or lesser degree and provide greater resistance to withdrawal of the anchor after the anchor has been driven into the ground and rotated to the point where the wings lie substantially normal to the tension direction of the cable.

While such anchors, both of the wingless, small-winged and large wing design, have found successful utility in many applications, including use in connection with revetment and soil retaining mats. However, the chiseled or sharpened leading edges which facilitate penetration into the ground can, in certain instances, cause damage to certain types of soil retaining mats which are commonly used in turf reinforcement and ground stabilization. Such mats, often known as High Performance Turf Reinforcement Mat (HPTRM) of the type available under the mark Pyramat from Propex, Inc. or of the type shown, for example, in U.S. Pat. No. 5,616,399 entitled "Geotextile Fabric Woven or a Honeycomb Weave Pattern and having a Cuspated Profile after Heating," may consist of individual strands essentially woven together and formed or fused to provide the mat. The strands are generally manufactured of plastics material. Other fabric-like woven mats utilizing similar or different materials are also known, as are non-woven mats. Where it is desired to anchor such mats to the underlying soil, the use of the previously known driven pivoting anchors can cause damage to the mat, particularly since the chiseled or sharpened leading edges will have a tendency to cut through the material of the mat, thereby weakening the mat.

It would therefore be an advance in the anchoring field to provide an anchor suitable for use with such turf reinforcement mats which could be driven through the mat with a reduced likelihood of damage to the mat.

SUMMARY OF THE INVENTION

The above advances are provided by the current invention by utilizing a driven pivotal anchor where the leading end is provided with a curved or rounded non-sharp leading end and flattened guiding plane edges.

In an embodiment of the invention a plurality of ribs or guiding plane leading edges extend forwardly of the generally cylindrical main body portion of the anchor with each edge being either blunt or rounded and with each edge converging to a common leading end which is generally rounded.

In an embodiment of the invention the leading edges projecting forward of the generally radial cylindrical main body portion are circumferentially spaced from one another and formed as the outside surface of ribs or guiding planes with the edges formed blunted or rounded and which converge to a common leading front end, the leading front end being rounded.

In an embodiment of the invention the generally cylindrical body member has four leading edges formed as orthogonal ribs or planes extending forwardly of the generally cylindrical body portion and tapering to a common leading end which is rounded generally in a partial spherical configuration.

It is therefore an object of the invention to provide a ground anchor having improved utility for use with mat structures having leading edge surfaces having a reduced tendency to damage the mat during driving of the anchor through the mat structure.

It is a further and more specific object of this invention to provide a driven pivoting anchor having a rounded or ball-like leading end.

These and other objects will be apparent to those of ordinary skill in the art from a description of the illustrated preferred embodiment, being understood that this is only one such embodiment of this invention and that many variations of shape and dimension are within the scope of this invention. Specifically the generally overall shape of the anchor, the shape of the main central body portion, the shape and extent of the side wings and the number of leading edges or ribs are all modifiable as is generally known to those of ordinary skill in the art and practice in differing commercially available embodiments of driven pivoting anchors.

DESCRIPTION OF THE PREFERRED EMBODIMENT

Figure 1:
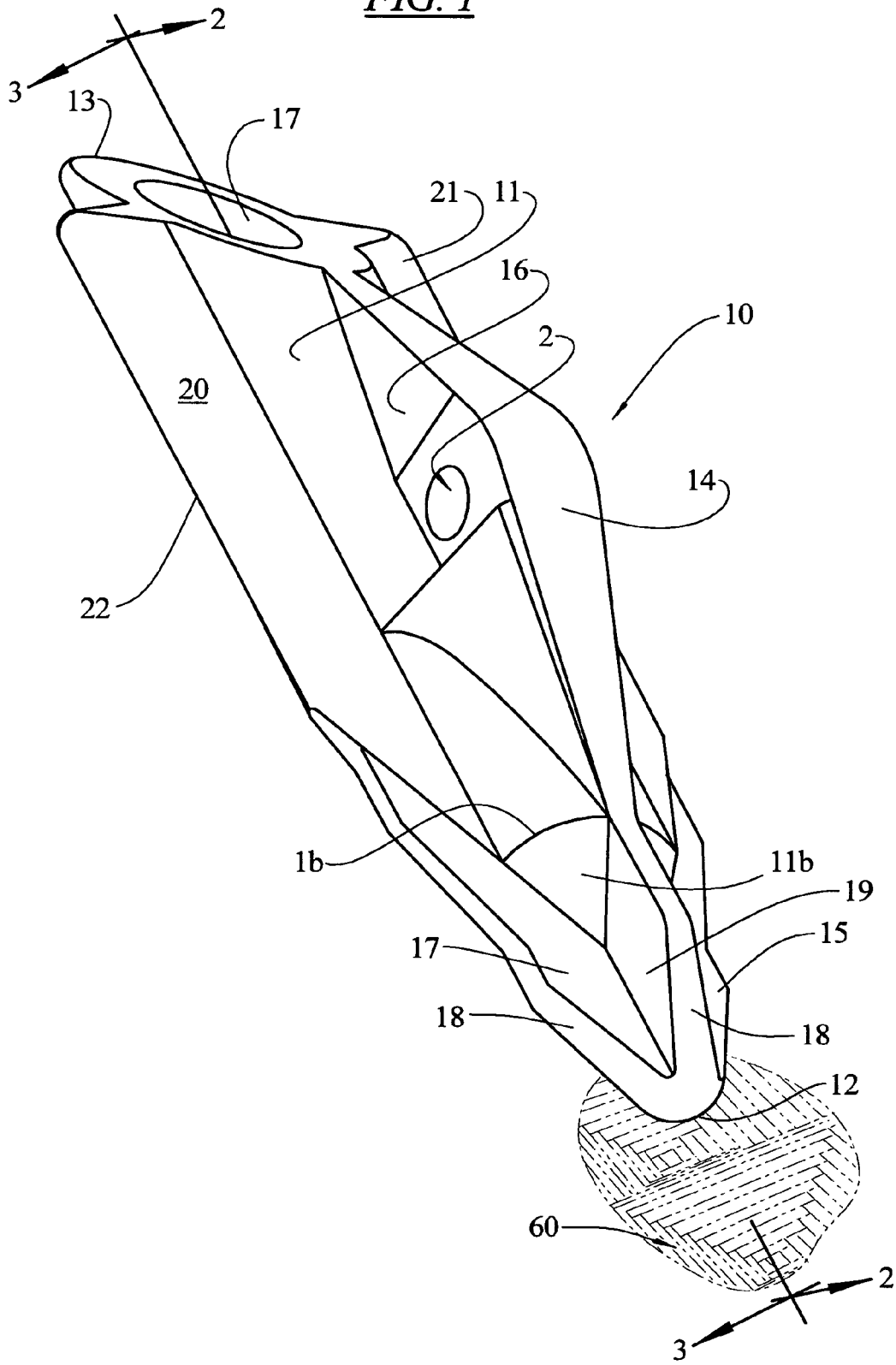
FIG. 1 is a perspective view of the anchor of this invention.

FIG. 1 illustrates a ground or earth anchor 10 of the type often referred to as a driven and rotating or pivoting anchor in that the anchor is driven into the ground by force and after having being driven to the desired depth, a cable or rod attachment member attached to the anchor is pulled in a direction to withdrawal the anchor from the ground. Because of the design of the anchor and the position of the attachment of the cable or pulling rod to the anchor, the pulling of the anchor by the attachment member causes the anchor to undergo a pivoting or rotation in the ground towards a final position in which the longitudinal axis of the anchor is positioned more towards a position normal to the pulling cable or rod.

Figure 2:
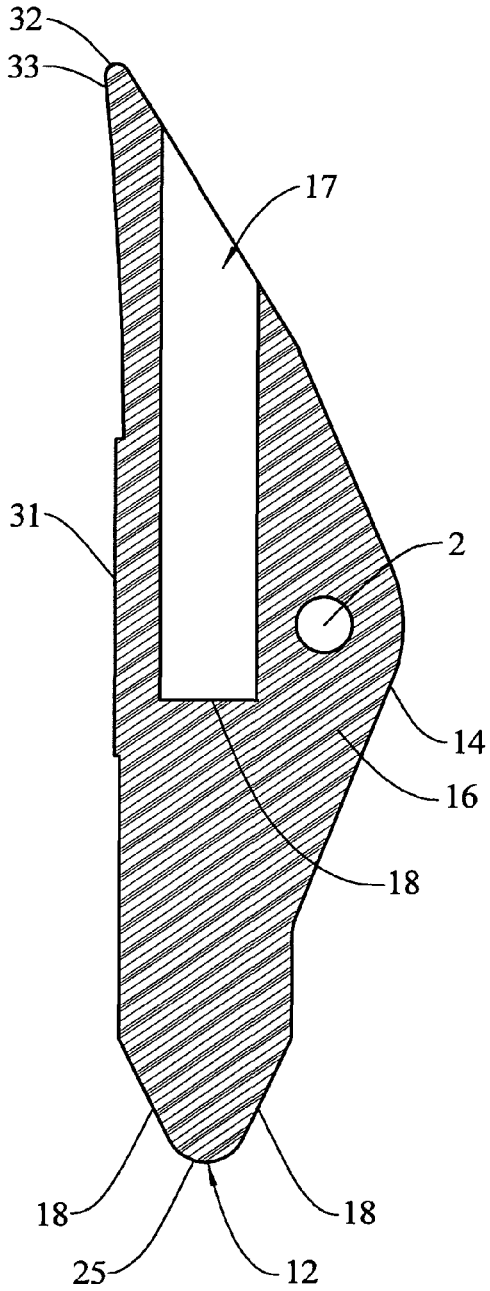
FIG. 2 is a cross sectional view of the anchor of this invention taken along the lines 2-2 of FIG. 1.
Figure 3:
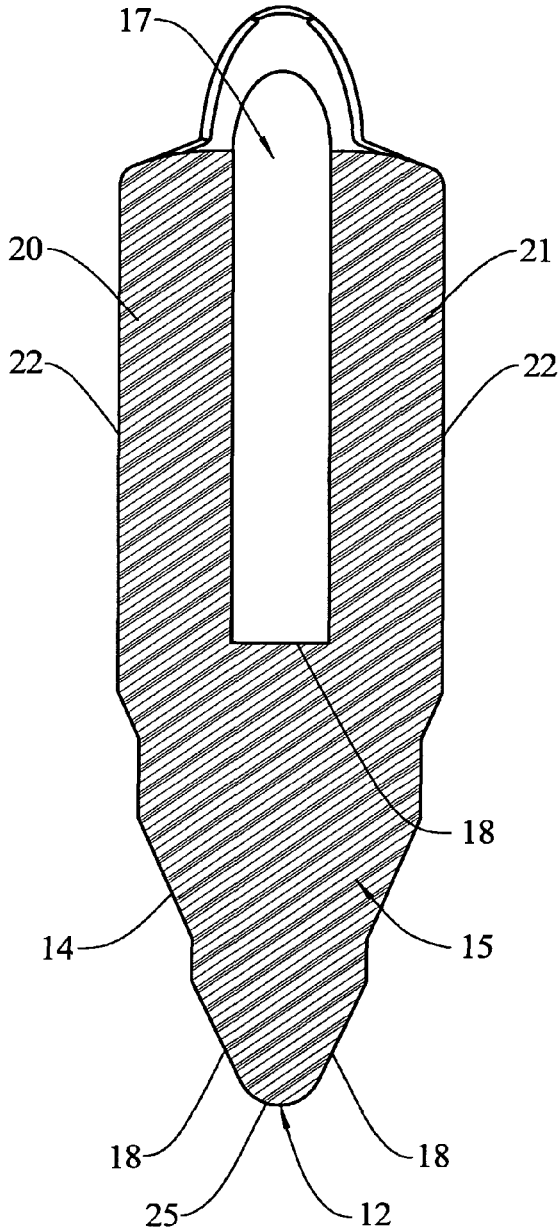
FIG. 3 is a cross sectional view of the anchor taken along the lines 3-3 of FIG. 1.

Such anchors often include a main body section 11, which may be generally cylindrically formed (other shapes are known in the art, including rectangular and oval), a leading edge 12, a trailing edge 13, a raised section 14 having means 2 for attachment of a cable, shackle, pivot bolt or the like, which may comprise or be attached to the withdrawing force member which causes the anchor to rotate or pivot from its driven position to its final locked position. As shown in FIG. 1, oftentimes the attachment means 2 is merely an opening through a raised rib 16 on one side of the main body portion 11. The opening may receive a looped crimped cable end or a shackle bracket or the like. Alternative structures are well known such as where the rib-like structure includes attachment means for receipt of the end of a T-shaped rod or other type of swiveling device. An open bore 17 in the trailing edge extends into the main body portion 11 terminating in a blind end 18 which may, as shown in FIGS. 2 and 3, be flat or which may be rounded or otherwise configured. A driving rod extends into the bore 17 and is used to drive the anchor into the earth. The driving rod may simply be impacted by a hammer for smaller anchors or may be driven by a pneumatic or hydraulic reciprocating power driver for larger anchors.

In the embodiment illustrated the main body portion is generally cylindrical and terminates at a leading end 11*a* of the main body portion in a frustoconical section 11*b* and four equally-distanced spaced ribs of which three, 15, 17, and 19 can be seen in FIG. 1, the fourth being on the bottom opposite the rib 19. Each of the ribs has an outer edge surface 18 and the rib surfaces 18 converge towards the leading end 12. The outer edges 18 may be flat or blunt as shown in FIG. 1 or may be outwardly curved but preferably are not provided with a sharp edge. The ribs 15, 16, 17 may have different shapes. The ribs 15 and 17 extending back behind the frustoconical portion 11*b* and converge into side wings 20 and 21, which also preferably have rounded or non-sharp outer edges 22. The rib 19 has its edge 18 extending back to the leading end of the generally conical section 11*a* and blending into the top edge surface 14 of the raised rib 16.

The four ribs, in this embodiment, converge together to a rounded nose 25 at the end 12. Although different shapes can be provided for the nose, a part spherical or partial ball shape is preferred, although a parabolic shape or some other curvature is acceptable, it being important that the leading end 12 not be provided with a sharp edge. By providing a rounded leading edge 12, the anchor is able to be driven through the mat with minimal damage to the stranding of the mat and, in fact, for smaller anchors without severing any of the strands of the mat as the ball-like nose 25 pushes its way between the strands and non-sharp, rounded or blunt edges 18 force the strands apart as the main body portion of the anchor begins to pierce through the mat.

The side 31 of the anchor opposite the raised rib 16 is provided at its trailing edge 32 with an outturned lip 33 to facilitate pivoting during drawback, as is well known in the art.

In use the mat schematically shown at 60 is placed in position on the surface to be retained or secured and the ball-like nose of the anchor is placed against the mat surface and is then begun to be driven through the mat. As the ball-like nose, or rounded nose, enters the structure of the mat it will cause the strands of the mat to be pushed aside. As the anchor is driven further into the mat, the degree by which the strands are pushed aside will increase to allow the anchor to pass through the mat. In many instances utilizing normally stranded mats and standard smaller sized anchors equipped with the rounded or ball-like nose leading edge, the entire anchor can be pushed through the mat without breaking the strands of the mat. In other instances when slightly larger anchors are used one or more of the strands may be stretched beyond its limit and separate, but damage to the mat is minimal compared to the use of sharper or chiseled or leading edges or sharper edges extending backwardly from a leading point. While the use of blunted, rounded non-sharpened nose portions and leading side edges on the ribs and along the body may increase the resistance to driving of the anchor into the ground, when such anchors are used for soil erosion or soil stabilization, they are most often used in connection with looser or less resistant soil conditions such that the disadvantage, which may rise from an increase in resistance to driving in comparison to chiseled edged or sharpened edged anchors is minimized.

It will therefore be understood from the above that this invention improve upon the prior art driven pivoting anchors by providing an intentionally rounded non-sharp leading nose or leading end which can be pushed through a woven or non-woven retaining mat with minimal damage to the mat.

Persons of ordinary skill in the art will understand that this invention may be practiced in embodiments other than that illustrated. It is not intended that this invention be limited to the particular anchor shape shown.

I claim as my invention:

1. A driven pivoting anchor of the type having a leading end to be driven into the ground, an intermediate generally cylindrical main body portion from which the leading end projects in a plurality of circumferentially spaced apart rib members and a trailing end adapted to receive a driving instrument for applying a longitudinal driving force to the anchor, the anchor having an attachment point for attaching a withdrawal member, comprising the leading end being generally part spherical, non-pointed, non-sharp having an apex generally aligned with the driving force and being formed by the juncture of the outer rounded edges of at least three of the rib members each of which has opposite side generally flat surface portions circumferentially spaced from the generally flat surface portions of the adjacent ribs until beginning formation of the leading end apex, the rib members extending forward of the main body portion.

2. The anchor of claim 1 wherein the leading end is generally part ball-shaped.

3. The anchor of claim 1 wherein the leading end is generally parabolic in cross section.

4. The anchor of claim 1 wherein the leading end is generally bullet-shaped.

5. The anchor of claim 1 wherein the plurality of ribs extend forward of the main body portion to the leading end, the ribs having generally planer opposite sides and outer edges, the outer edges converging towards one another to the leading end and being rounded adjacent the leading end's apex to provide a curved bullet-shaped nose at the leading edge.

6. A driven pivoting anchor comprising a main body portion, a leading edge and a trailing edge, with a blind bore extending into the main body portion from the trailing edge, a raised rib section on the main body portion having an attachment point for attachment of a withdrawal member, with a plurality of circumferentially spaced rib-like members extending forwardly from the main body member to the leading edge the leading edge comprising a rounded non-pointed, non-sharp surface and the rib members having curved outer edge surface sections converging to the leading edge, the outer edge surfaces blending together to form the apex of the rounded surface of the leading edge, at least one of the ribs having substantially flat opposite side portions spaced from the apex and an outer edge which is aligned with, and blends into, a top surface of the raised rib.

7. The anchor of claim 5 wherein four ribs are provided spaced equal distantly apart, two of the ribs extending backwardly from the leading edge beyond a forward portion of the main body portion and blending into side wings formed alongside the main body portion.

8. The anchor of claim 6 wherein the rounded leading edge is generally part spherically shaped in the areas formed by the edges of the ribs.

9. The anchor of claim 8 wherein the main body portion has a raised rib on one side of the main body portion defining an attachment for attaching a withdrawal member for causing pivoting of the anchor to a final position after the anchor has been driven into the ground.

10. A driven, pivoting anchor comprising a generally cylindrical main body portion, at least three circumferentially spaced rib members projecting forwardly of the main body portion, the rib members having outer edges and generally flat side faces, the outer edges being rounded at least adjacent a leading edge terminating the ribs at a forward end of the anchor, the leading end being rounded, non-pointed, non-sharp having a generally curved outer surface from an apex backwardly a distance towards the main body.

11. The anchor of claim 10 wherein the raised rib converges into one of the at least three ribs forward of the main body portion.

* * * * *